US005934887A

United States Patent [19]

Veit

[11] Patent Number: 5,934,887

[45] Date of Patent: Aug. 10, 1999

[54] HIGH-PRESSURE CLEANING DEVICE

[75] Inventor: Eberhard Veit, Goppingen, Germany

[73] Assignee: Alfred Karcher GmbH & Co., Winnenden, Germany

[21] Appl. No.: 08/865,389

[22] Filed: May 29, 1997

Related U.S. Application Data

[63] Continuation of application No. PCT/EP94/04088, Dec. 8, 1994.

[51] Int. Cl.[6] ..... F04B 17/04

[52] U.S. Cl. ..... 417/417; 92/71; 92/161

[58] Field of Search ..... 92/12.2, 71, 161; 417/269, 417; 91/499, 504, 505

[56] References Cited

U.S. PATENT DOCUMENTS

| | | | |
|---|---|---|---|
| 2,402,244 | 6/1946 | Elberty | 417/417 |
| 4,388,808 | 6/1983 | Durenec | 417/271 |
| 4,403,924 | 9/1983 | Gebauer | 417/388 |
| 4,931,678 | 6/1990 | Lutz . | |
| 5,632,607 | 5/1997 | Popescu et al. | 417/269 |

FOREIGN PATENT DOCUMENTS

WO 92/16774 10/1992 WIPO .

*Primary Examiner*—Thomas E. Denion
*Attorney, Agent, or Firm*—Barry R. Lipsitz

[57] ABSTRACT

In order to enable the production of the motor shaft to be simplified in the case of a high-pressure cleaning device comprising a piston pump, the pistons of which are driven by a motor via a wobble plate non-rotatably connected to the motor shaft of the motor, it is suggested that the wobble plate be non-rotatably connected by means of form locking to a coupling element consisting of plastic, this coupling element being attached at its end face to the motor shaft circular in cross section and being tensioned against the end face of the motor shaft by a tension rod held in the motor shaft, thereby forming a friction contact.

10 Claims, 2 Drawing Sheets

HIGH-PRESSURE CLEANING DEVICE

Figure 1:
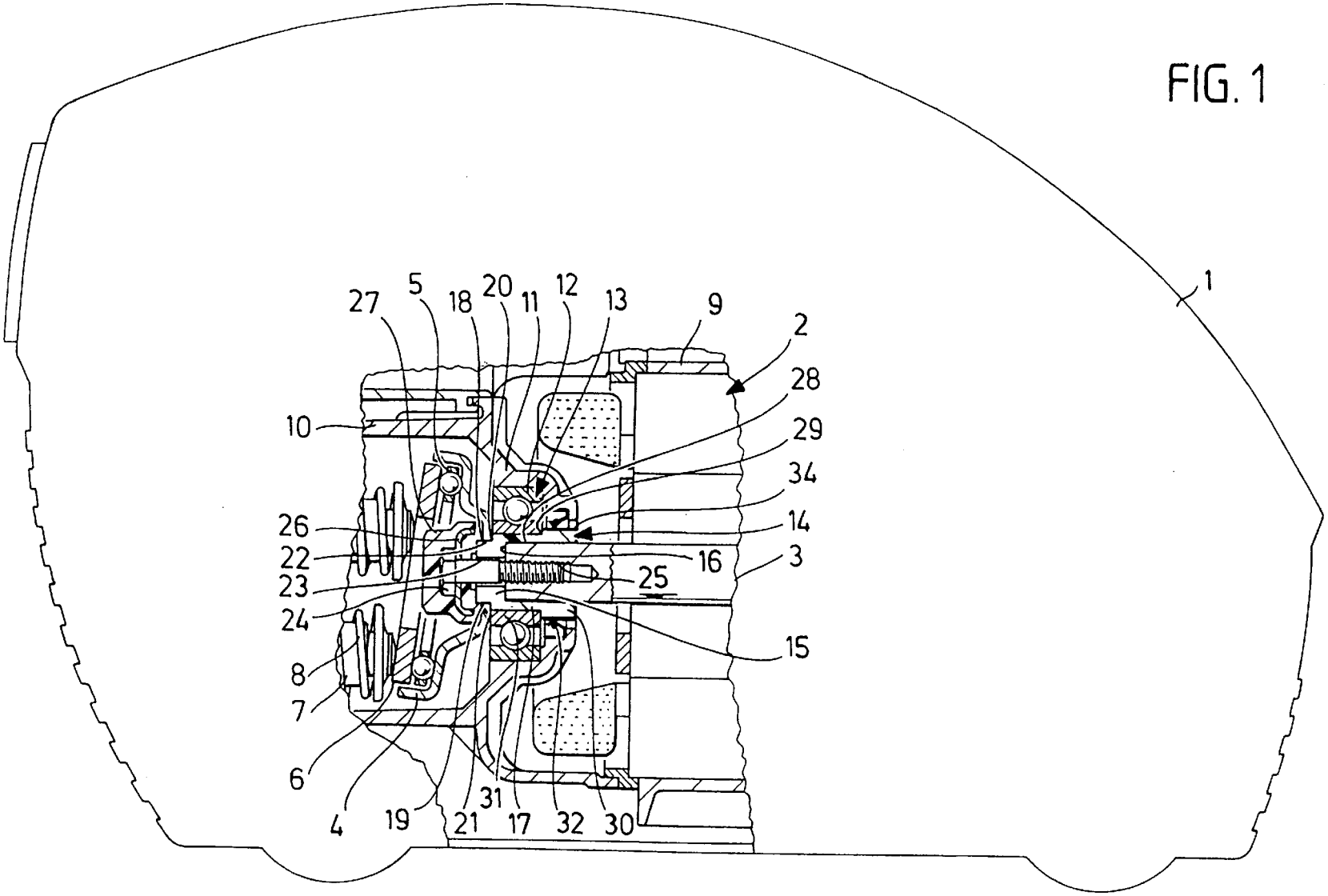

This application is a continuation of International PCT Application No. PCT/EP94/04088 filed on Dec. 8, 1994.

The invention relates to a high-pressure cleaning device with a piston pump, the pistons of which are driven by a motor via a wobble plate non-rotatably connected to the motor shaft of the motor. In the case of known high-pressure cleaning devices of this type, the wobble plate is non-rotatably connected to the motor shaft in that the motor shaft has lateral flattened areas and that the wobble plate engages over the end of the motor shaft with a complementary, central recess so that the edges of the recess abut on the flattened areas of the motor shaft. This results in a form-locking rotational connection but a precondition is that the motor shaft has lateral flattened areas. In order to provide a motor shaft with such lateral flattened areas, the motor shaft must be machined in a special working step, for example by a milling tool. Since the motor shaft is generally produced with a turning tool, this means a completely different working step with a different tool, and this additional machining is complicated.

The object of the invention is to avoid this additional, complicated working step in a generic high-pressure cleaning device and to provide a non-rotational connection between wobble plate and motor shaft without the necessity of an additional machining of the motor shaft.

This object is accomplished in accordance with the invention, in a high-pressure cleaning device of the type described at the outset, in that the wobble plate is non-rotatably connected by means of form locking to a coupling element consisting of plastic which is attached at its end face to the motor shaft circular in cross section and which is tensioned against the end face of the motor shaft by a tension rod held in the motor shaft, thereby forming a friction contact.

It has surprisingly been found that when using a coupling element of this type consisting of plastic a form-locking rotary connection between the coupling element, on the one hand, and the motor shaft, on the other hand, can be dispensed with. A sufficiently rigid rotary connection is obtained solely by means of friction contact, i.e. in that the coupling element is tensioned against the motor shaft at its end face. With this construction, the motor shaft can retain its circular cross section; it is, therefore, no longer necessary to manufacture the motor shaft to be non-circular in the connecting area by means of an additional working step in order to achieve a rotary connection by means of form locking.

It has, in fact, already been suggested to cover the motor shaft in generic high-pressure cleaning devices with a plastic sleeve which can also be pressed against the end face of the motor shaft by means of a tension rod but this plastic sleeve serves, exclusively, for the electrical insulation of the wobble plate in relation to the motor shaft. With this suggested construction, one has, however, still proceeded on the basis that a form-locking connection is also necessary between the attached, electrically insulating plastic sleeve and the motor shaft, and for this reason the motor shaft in this suggested construction is still provided with lateral flattened areas which engage between complementary flattened areas of the plastic sleeve, thereby forming a form-locking connection (PCT/EP94/03086).

In a preferred embodiment of the invention, it is provided for the tension rod to tension the wobble plate against the coupling element in addition in the direction of the longitudinal axis of the motor shaft. It is thereby possible to clamp together the constructional unit consisting of wobble plate, coupling element and motor shaft by using a single tension rod.

The tension rod can, in particular, be a tightening screw screwed into the motor shaft at its end face.

In a first embodiment, the coupling element is a plate which is simply inserted between the wobble plate, on the one hand, and the end face of the motor shaft, on the other hand.

It is particularly advantageous when, in accordance with a preferred embodiment, the coupling element is a sleeve pushed onto the motor shaft. In this respect, the motor shaft can have a consistently equal external diameter; any machining in the slip-on region can, therefore, be omitted.

It would also be possible for the motor shaft to have a smaller external diameter in the region covered by the sleeve than in the region adjoining it. In order to bring about this stepped design of the motor shaft, an additional working step is required but this can be carried out with the same tool and on the same machine as the production of the motor shaft itself and so a stepped design of this type is considerably less complicated with respect to production than a non-circular construction of the motor shaft, for example due to a lateral flattened area.

It is favorable when the sleeve bears at its free edge an annular collar projecting in a step-like manner and extending around in circumferential direction. This can serve as a stop for the inner cage of a ball bearing which is pushed onto the sleeve-like coupling element.

In order to provide a form-locking connection between coupling element, on the one hand, and wobble plate, on the other hand, it may be provided for the coupling element to have two lateral flattened areas located opposite one another and for these to abut on the longitudinal edges of a central elongated hole in the wobble plate.

In this respect, it is advantageous when the flattened areas end in a step, on which the wobble plate abuts due to the tension rod.

Figure 2:
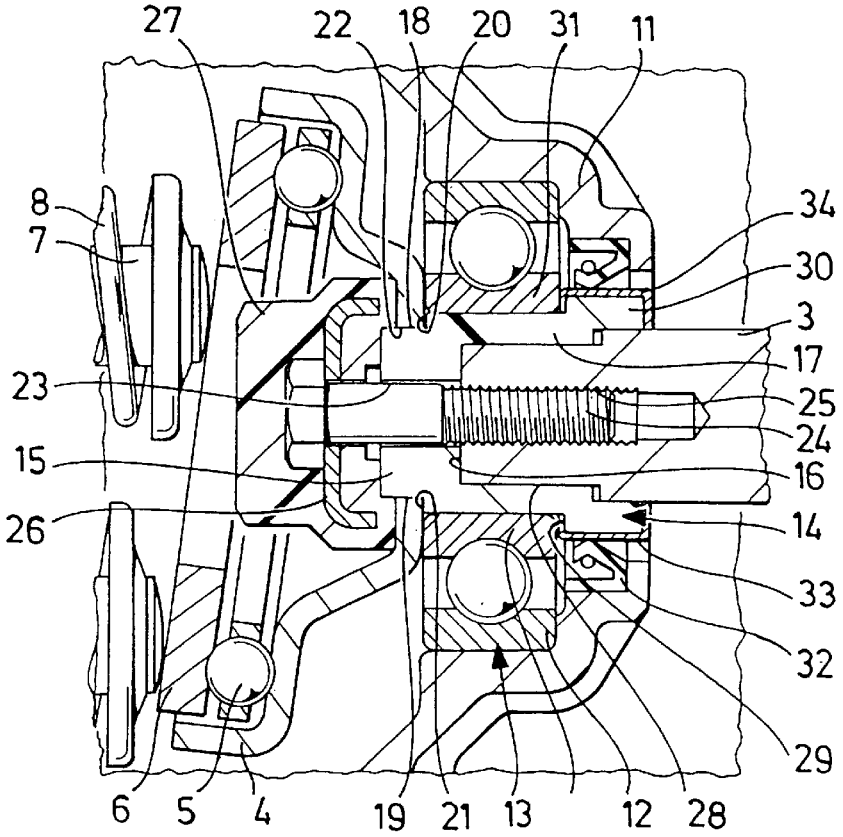
Figure 3:
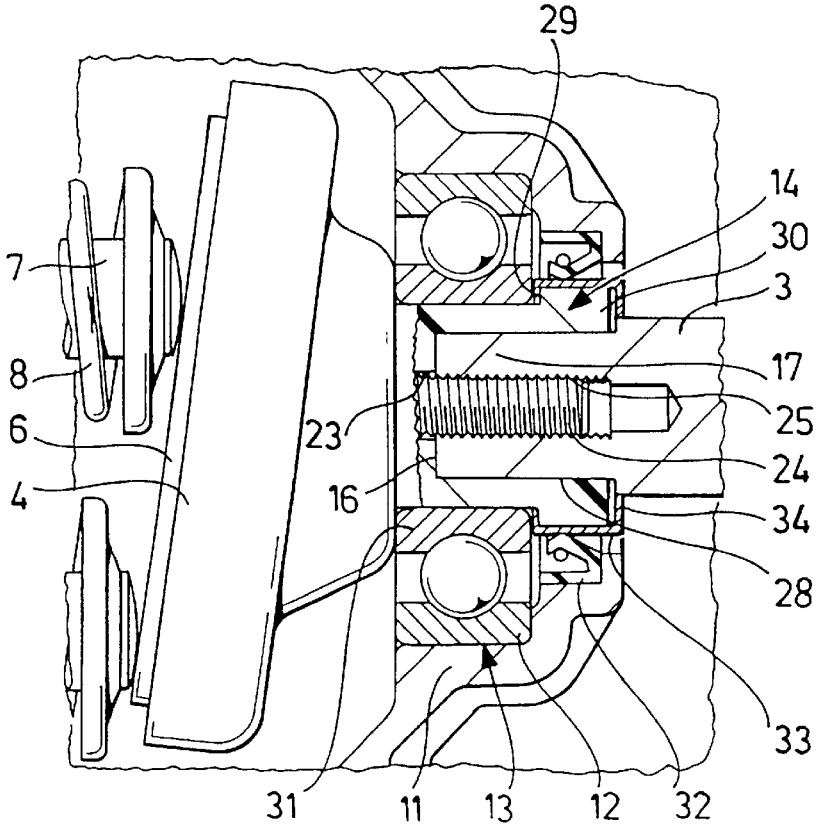

The following description of preferred embodiments of the invention serves to explain the invention in greater detail in conjunction with the drawings. In the drawings:

FIG. 1: shows a schematic view of a high-pressure cleaning device with a detailed illustration of the wobble plate region cutaway in longitudinal direction;

FIG. 2: shows a longitudinal sectional view of the wobble plate region in a modified embodiment of a high-pressure cleaning device and FIG. 3: shows a view similar to FIG. 2 in a further embodiment of a high-pressure cleaning device.

The high-pressure cleaning device illustrated in FIG. 1 comprises a housing 1, in which an electromotor 2 with a motor shaft 3 extending in a horizontal direction is arranged. At its free end protruding out of the electromotor 2, the motor shaft 3 bears a wobble plate 4, in which a pressure plate 6 is rotatably mounted via a ball bearing 5. This plate supports pistons 7 of a piston pump which is not illustrated in greater detail in the drawings, these pistons being pressed against the pressure plate 6 by means of helical springs 8 surrounding the pistons 7.

The electromotor 2 is located in a motor housing 9 adjoined by a pump housing 10 surrounding the wobble plate 4, the pistons 7 and the pump which is not illustrated. In the transitional region, a transverse wall 11 of the motor housing 9 forms a bearing bracket, in which the outer cage 12 of a ball bearing 13 is supported, by means of which the motor shaft 3 is mounted in the transverse wall 11.

A plastic sleeve 14 is pushed onto the motor shaft 3 at its end face, the bottom 15 of this sleeve abutting on the end face 16 of the motor shaft 3 and the wall 17 of this sleeve surrounding the motor shaft 3 at its circumferential surface so as to abut tightly on it.

The bottom 15 of the plastic sleeve 14, which is of a somewhat thicker design, has two lateral flattened areas 18, 19 which are located opposite one another, extend parallel to the longitudinal axis of the motor shaft and each end in a radially projecting step 20 and 21, respectively. In this region having the flattened areas 18, 19, the bottom 15 of the plastic sleeve 14 dips into a complementary, central recess 22 of the wobble plate 4 in the shape of an elongated hole so that the longitudinal edges of the recess 22 abut tightly against the flattened areas 18, 19 and thus connect the wobble plate 4 non-rotatably with the plastic sleeve 14.

A tightening screw 24 is inserted through a central opening 23 in the bottom 15 of the plastic sleeve 14, this screw being screwed into a central, internally threaded bore 25 in the end face of the motor shaft 3. A metallic disk 26 protruding laterally over the head of the tightening screw 24 is placed on the tightening screw 24 and coated with plastic together with the head of the tightening screw 24 and the shaft region of the tightening screw 24 directly adjoining thereto so that the tightening screw 24 has an enlarged plastic head 27 which is supported on the wobble plate 4 and presses this against the steps 20, 21 for the plastic sleeve 14 when the tightening screw 24 is screwed into the motor shaft 3. Moreover, the tightening screw 24 tensions the bottom 15 of the plastic sleeve 14 against the end face 16 of the motor shaft 3 and thus provides a friction contact in the abutment region of the bottom 15 on the end face 16, as a result of which the plastic sleeve 14 is taken along during rotation of the motor shaft 3, namely without the necessity of a form-locking connection between motor shaft 3, on the one hand, and plastic sleeve 14, on the other hand. The plastic sleeve 14 thus forms a coupling element between motor shaft and wobble plate which manages without any form-locking connection in the transitional region to the motor shaft. It is, therefore, not necessary to design the motor shaft to be non-circular in this region for forming a form-locking connection. The coupling element can, for example, consist of high-strength, high-temperature materials, for example polyphenylene sulfide (PPS), polyphtalamide (PPA), polyaryl ether ketone (PAEK), or of duroplastic materials; in this respect, it is favorable when these plastic materials have a Shore hardness >70 Shore D.

The different embodiments shown in FIGS. 1 to 3 differ only in a few details; parts corresponding to one another therefore have the same reference numerals. In the embodiment illustrated in FIG. 1, the motor shaft can have a constant external diameter over its entire length, in the embodiments of FIGS. 2 and 3 the motor shaft has a section 28 with a smaller external diameter in the region covered by the plastic sleeve 14 but the motor shaft 3 is also designed in this section 28 to be circular so that the production of the section 28 can take place with the same turning tool, with which the motor shaft is produced as a whole.

The plastic sleeve 14 bears at its end located opposite the bottom 15 an annular collar 30 which projects radially, thereby forming a step 29, and extends in circumferential direction and its step 29 forms a stop for the inner cage 31 of the ball bearing 13 which directly surrounds the plastic sleeve 14. The motor shaft 3 is therefore mounted in the ball bearing 13 with the plastic sleeve 14 as an intermediate layer.

In the embodiment of FIG. 2, the plastic sleeve 14 extends in longitudinal direction beyond the section 28 with a smaller external diameter and also surrounds part of the motor shaft 3 with a larger external diameter; in the embodiment of FIG. 3, the plastic sleeve 14 is designed to be so short that it is arranged only in the section 28 with a smaller external diameter. In the region of the annular collar 30, a seal is provided in all cases, in addition, between the plastic sleeve 14 and the transverse wall 11 by means of an annular seal 32 and so, in this way, the interior of the motor housing 9 is also sealed in relation to the interior of the pump housing 10. To produce this seal, the annular collar 30 can have a metallic outer layer 33 which is formed, for example, by a metal ring 34 which is pushed onto the free end of the plastic sleeve 14.

I claim:

1. A high pressure cleaning device comprising:

a piston pump having pistons drivable by a motor via a wobble plate;

said wobble plate being mounted to a plastic coupling element via a form locking connection, said coupling element being attached to a motor shaft of said motor for non-rotatably connecting the wobble plate to the motor shaft; and a tension rod held in the motor shaft for tensioning an end face of said coupling element to an end face of the motor shaft to form a friction contact;

wherein the coupling element comprises a sleeve pushed onto a circular cross section of the motor shaft having a smaller external diameter than a region of the motor shaft adjoining the sleeve, said sleeve bearing at its free end an annular collar projecting in a step-like manner and extending around said region of the motor shaft in a circumferential direction.

2. A high pressure cleaning device as defined in claim 1, wherein the tension rod also tensions the wobble plate against the coupling element in the direction of a longitudinal axis of the motor shaft.

3. A high pressure cleaning device as defined in claim 1, wherein the tension rod comprises a tightening screw screwed into the end face of said motor shaft.

4. A high pressure cleaning device as defined in claim 2, wherein the tension rod comprises a tightening screw screwed into the end face of said motor shaft.

5. A high pressure cleaning device as defined claim 1, wherein the coupling element has two lateral flattened areas located opposite one another abutting on the longitudinal edges of a central elongated hole in the wobble plate.

6. A high pressure cleaning device as defined claim 2, wherein the coupling element has two lateral flattened areas located opposite one another abutting on the longitudinal edges of a central elongated hole in the wobble plate.

7. A high pressure cleaning device as defined claim 3, wherein the coupling element has two lateral flattened areas located opposite one another abutting on the longitudinal edges of a central elongated hole in the wobble plate.

8. A high pressure cleaning device as defined in claim 5, wherein the flattened areas end in a step, and the wobble plate abuts on said step due to the tension rod.

9. A high pressure cleaning device as defined in claim 6, wherein the flattened areas end in a step, and the wobble plate abuts on said step due to the tension rod.

10. A high pressure cleaning device as defined in claim 7, wherein the flattened areas end in a step, and the wobble plate abuts on said step due to the tension rod.

* * * * *